US006608264B1

(12) United States Patent
Fouladpour

(10) Patent No.: US 6,608,264 B1
(45) Date of Patent: Aug. 19, 2003

(54) SWITCHABLE DATA AND POWER CABLE

(76) Inventor: Afshin Fouladpour, 749 Glen Rd., Danville, CA (US) 94526

( * ) Notice: Subject to any disclaimer, the term of this patent is extended or adjusted under 35 U.S.C. 154(b) by 0 days.

(21) Appl. No.: 10/112,458

(22) Filed: Mar. 29, 2002

(51) Int. Cl.[7] ..... H01R 33/96

(52) U.S. Cl. ..... 200/51.03; 200/51.11; 307/64; 307/150

(58) Field of Search ..... 200/51 R, 51.02, 200/51.03, 51.05, 51.06, 51.07, 51.11; 307/64, 70, 72, 80, 85, 28, 112, 139, 150; 324/508; 361/785; 439/652, 214, 188

(56) References Cited

U.S. PATENT DOCUMENTS 4,855,611 A * 8/1989 Isobe et al. ..... 307/125
5,900,684 A * 5/1999 Lam ..... 307/139
5,955,797 A * 9/1999 Kim ..... 307/150
6,169,340 B1 * 1/2001 Jones ..... 307/64
6,410,869 B1 * 6/2002 McNutt ..... 200/51 R
6,459,051 B1 * 10/2002 Barkley ..... 200/16 E

* cited by examiner

*Primary Examiner*—Michael Friedhofer
(74) *Attorney, Agent, or Firm*—Beyer Weaver & Thomas, LLP

(57) ABSTRACT

A switchable cable that can selectively deliver power to a computing device either from a primary or an alternative power source is described within. The cable can also be set so that no power is delivered to the computing device through the cable. The cable can be any of a variety of cables that transmit both data and power.

15 Claims, 3 Drawing Sheets

SWITCHABLE DATA AND POWER CABLE

FIELD OF THE INVENTION

The present invention relates generally to electronic interface devices, and more specifically to bus-powered serial cables.

BACKGROUND OF THE INVENTION

The present invention provides versatility and convenience for people who use interface devices to interconnect electronic devices such as computers and peripheral devices. Interface devices, such as cables, commonly connect peripherals and computers so that functions such as data file transfer and software application loading can be performed. Examples of these peripheral devices include portable data assistants and audio file players. In some cases, such interface devices can also deliver power from the computer to the peripheral device. These peripheral devices use the delivered power to operate or to charge internal batteries. Examples of cables that transfer both data and power are bus powered serial cables such as universal serial bus (USB) and FireWire® type cables.

These bus-powered serial cables provide capabilities for high data transfer rates. Additionally, the bus-powering capabilities allow peripheral devices to have more simple designs. Even though these cables provide these benefits, improvements upon these cables can further improve a user's experience with the cable and provide additional features. Currently, there is no manner of selectively transferring data but not power through such cables when they connect two computing devices. The ability to selectively transfer power through the cable would be very useful, for example, when a peripheral device is connected to a laptop computer that may have a limited amount of battery power to transfer. This would also be useful in cases where, for example, a peripheral device operates in certain modes depending upon whether they receive power through the bus-powered cable. Typically, to control the delivery of power to the peripheral, a user must plug or unplug the cable to use the peripheral in a desired mode. Repeated plugging and unplugging of the cable is not only tedious, but it can also cause wear and tear upon the connecting elements of the cable and the connected computing devices. Also, considering that a computer to which a peripheral is connected may have a limited amount of power, it would also be beneficial for bus-powered cables to have the capability to supply power to the peripheral device from an alternative power source.

As can be seen, even though bus-powered serial cables are very useful, improvements to these cables with respect to power transfer can increase the flexibility in how they are used.

BRIEF SUMMARY OF THE INVENTION

The present invention is directed a switchable cable that can interconnect two computing devices and at least one alternative power source. A switch on the serial cable controls the delivery of power to one of the computing devices. For instance, in various switched modes, power can be drawn from the other computing device or from the alternative power source. Or, when the switch is in the "off" mode, no power is delivered to the computing device. The present invention provides the capability to use an alternative power source and provides a simple mechanism for selectively utilizing the alternative power source.

One aspect of the invention pertains to a cable for transmitting data and power. This cable includes a transmission medium, which transmits data signals and power, a first and a second connector formed at each end of the transmission medium, an alternative power connector, and a switch positioned on the transmission medium. The switch switches between at least two modes wherein in a first mode power is transmitted through the transmission medium between the first connector and the second connector, and wherein in a second mode power is transmitted through the transmission medium between the alternative power connector and the second connector.

These and other features and advantages of the present invention will be presented in more detail in the following specification of the invention and the accompanying figures, which illustrate by way of example the principles of the invention.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE INVENTION

The present invention will now be described in detail with reference to a few preferred embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known operations have not been described in detail so not to unnecessarily obscure the present invention.

The present invention generally pertains to a switchable cable that can interconnect two computing devices and at least one alternative power source. A switch on the cable controls the delivery of power to one of the computing devices. For instance, in various switched modes, power can be drawn from the other computing device or from the alternative power source. Or, when the switch is in the "off" mode, no power is delivered to the computing device. The present invention provides the capability to use an alternative power source and provides a simple mechanism for selectively utilizing the alternative power source. By providing a simple technique to use an alternative power source, wear and tear on cable connectivity components is avoided since a cable does not need to be plugged and unplugged between a primary power source, e.g. a computer, and an alternative power source.

Figure 1:
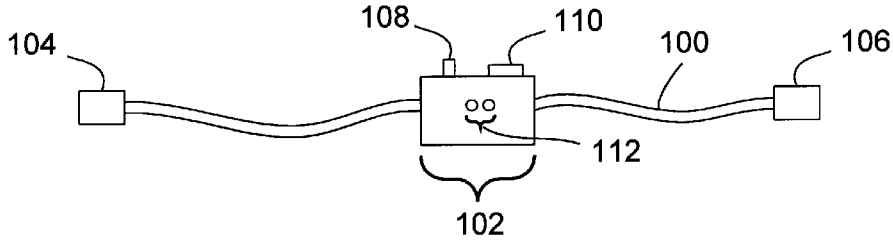
FIG. 1 illustrates a diagrammatic view of a switchable cable according to one embodiment of the present invention.
Figure 2:
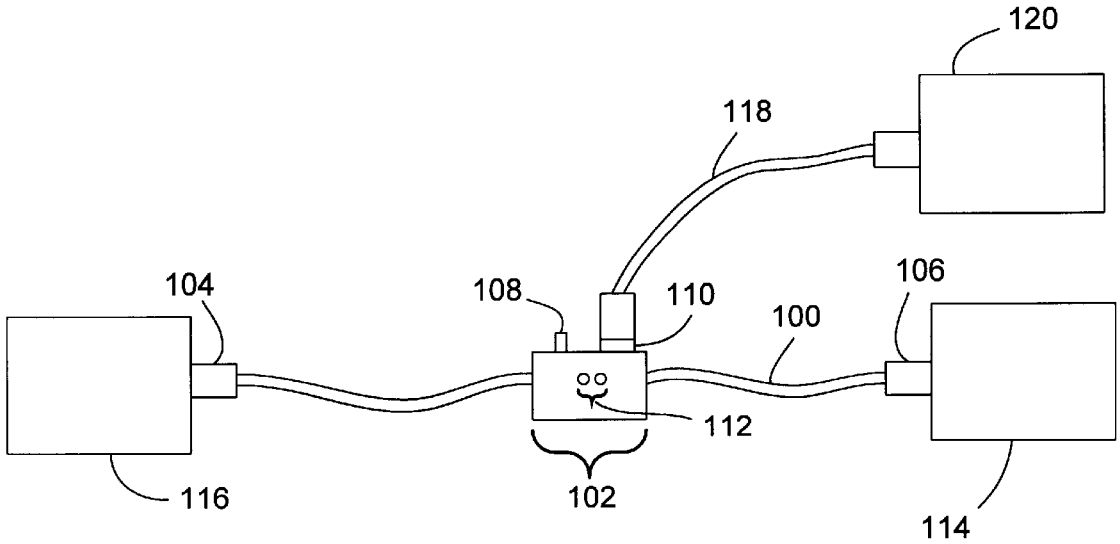
FIG. 2 illustrates a diagrammatic view of the switchable cable of FIG. 1 wherein the switchable cable is connected to two computing devices and to an alternative power source through a respective cable.

The present invention will now be described with the aid of the figures. FIG. 1 illustrates a diagrammatic view of a switchable cable 100 according to one embodiment of the present invention. FIG. 2 illustrates a diagrammatic view of the switchable cable 100 of FIG. 1 wherein cable 100 is connected to two computing devices and to an alternative power source through a respective cable.

The cable 100 is referred to as switchable because a switch 102 is located on cable 100 between the connector ends 104 and 106. Typically, one connector is referred to as the A connector and the other connector is referred to as the B connector. The A connector, or the upstream connector, is usually plugged into a computer or a hub. This computer or hub sometimes transmits power as well as data. The B connector, or the downstream connector, usually plugs into a peripheral device. This peripheral device can transmit and receive data from the computer and it can also receive power from the computer through cable 100. As shown in FIG. 2, connector 106 is the A connector and is connected to a computing device 114 and connector 104 is the B connector, which is connected to a peripheral device 116.

Switch 102 includes typical electrical circuitry for opening and closing circuits (internal to switch 102), a knob 108, alternative power connector 110, and light emitting diodes (LEDs) 112. Alternative power connector 110 is a female connector into which a cable can be inserted so that an alternative power source can be connected to cable 100. As shown in FIG. 2, cable 118 connects alternative power source 120 to switch 102 through alternative power connector 110. Alternative power connector 110 can have various shapes and sizes to receive variously shaped cable connectors. In some embodiments, alternative power connector 110 can be a male connector. Typically, the cable that connects to alternative power connector 110 is the same type of cable as cable 100, however, cable 118 can be different from cable 100. Switch 102 can be located anywhere along the length of cable 100.

Knob 108 can be flipped between the various positions offered by switch 102. Switch 102 can have two or more positions. Each of these positions controls if and how power is transferred to the B connector 104. For instance, in a first knob position, power can be transferred from A connector 106 to B connector 104. In other words, power can be transmitted from computing device 114 to peripheral device 116 in this first knob position. This is typically called the "standard" position. In a second knob position, power is transferred from an alternative power source 120 through cable 118 to B connector 104. In this case, power is transferred from the external power source to the peripheral device. The second knob position is referred to as the "juiced mode." In a third knob position, no power is delivered to connector B 104 from either the A connector 106 (and computing device 114) or alternative power source 120. The third knob position is referred to as the "off mode."

In alternative embodiments, additional knob positions can be added to deliver power to connector B through one of many alternative power sources. Each of these alternative power sources can be connected to switch 102 through a respective alternative power connector.

LEDs 112 can light up to indicate what position knob 108 has been placed in. LEDs are an optional feature of switch 102. Various configurations of LEDs can be added to switch 102 to indicate operation modes. In some embodiments, a specific LED indicates when power is delivered to B connector 104.

Connector ends 104 and 106 of cable 100 are constructed in a variety of shapes and sizes so that they can plug into various computer systems and peripheral devices. The connectors on each end of a cable can be both male, both female, or male and female. Some cables, for instance USB cables, have differently shaped A and B connectors.

Cable 100 can be a variety of transmission mediums that can transmit both data and power. For example, cable 100 can have two copper wire pairs for data transmission and one copper wire pair for power transmission. In some embodiments, the data transmission mediums within cable 100 can be optical fibers. Typically, cable 100 is a serial cable.

As mentioned above, switchable cable 100 can interconnect a variety of electronic components wherein one of the components can draw power from one of the other two components. Typically, component 114 of FIG. 2 is a computer that can supply data and power to component 116, which is a peripheral device. Many computers have a bus for supplying power through cables. Peripheral devices include devices such as a portable memory device (e.g., hard drive), an audio file player (e.g., an MP3 player), a personal data assistant (PDA), etc. Alternative power source 120 can be a variety of power sources including a power outlet, a battery pack, a car-lighter socket, or another computing device that supplies power. Switchable cable 100 provides a convenient mechanism for connecting an alternative power source to a peripheral device and then switching between the computing device 114 (the primary power source) and alternative power source 120. Switchable cable 100 also avoids the need to plug and unplug a traditional, non-switchable cable between a primary and a secondary power source. This avoids wear and tear on the connectors of the power sources.

Figure 4:
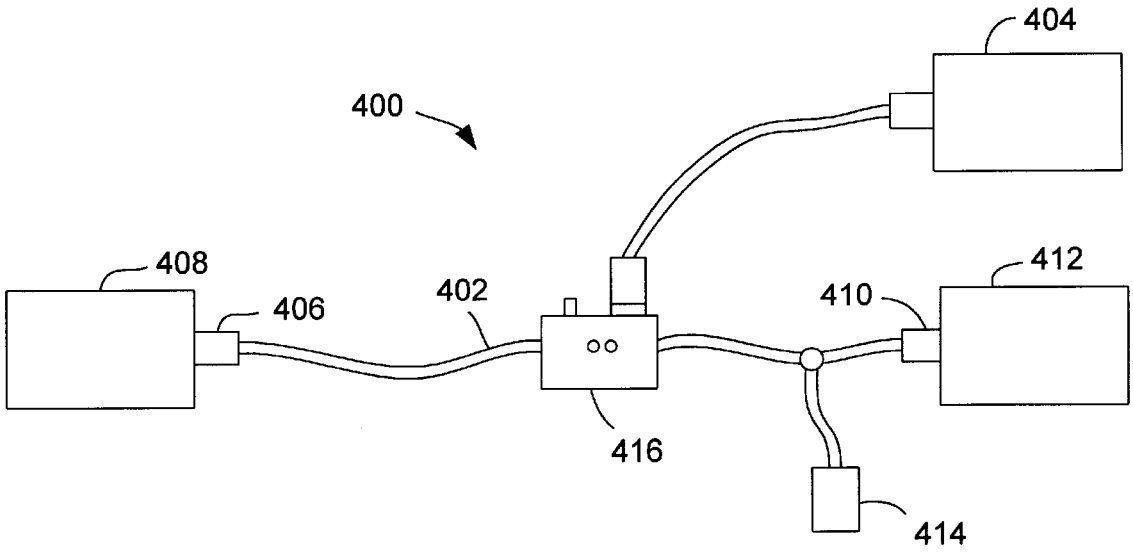
FIG. 4 illustrates a diagrammatic view of a switchable cable that is used in an Ethernet network.

In one embodiment, the switchable cable of the present invention can be used in a system where power is transmitted through an Ethernet network. In such system, an injector is used to inject power into the Ethernet cables. This type of system is referred to as Power over Ethernet. An embodiment of a Power over Ethernet system 400 is illustrated in FIG. 4. By using switchable cable 402, an alternative power source 404 can be conveniently integrated into the network. The B connector 406 can be connected to any DC powered device 408 such as a router, a switch, or a wireless base station. The A connector 410 can be connected to any node 412 of the Ethernet network. In some cases, component 412 is the same type of component as component 408. An injector 414 is connected to the cable 402 at a point between the A connector 410 and the switch 416. Power injector 414 could just as well be connected to switch 416.

In one embodiment of the invention, the knob position of switch 102 can be controlled remotely. For example, signals sent through the data transmission wires can be used to control the switch. Remote control of switch 102 is advantageous in that physical access to the switch would not be required to control the switch.

Figure 3:
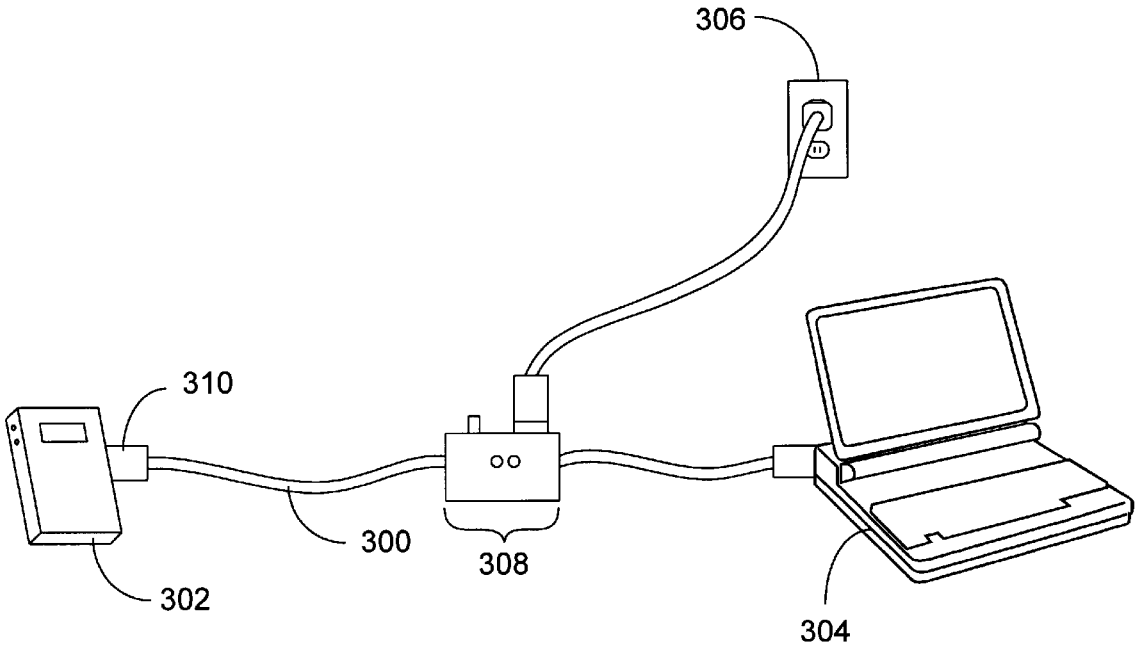
FIG. 3 illustrates a diagrammatic view of a switchable cable, which interconnects an audio file player, a laptop computer, and an electrical outlet that serves as an alternative power source.

FIG. 3 illustrates a diagrammatic view of a switchable cable 300, which interconnects an audio file player 302, a laptop computer 304, and an electrical outlet 306 that serves as an alternative power source. Some current audio players operate in modes depending upon whether it receives power through a data transmission cable such as cable 300. For instance, audio player 302 runs off its own batteries and is in a music playback mode when it does not receive power from cable 300. On the other hand, audio player 302 runs off the power supplied through cable 300 and is in a data storage and transfer mode when it receives power through cable 300. In this case, the power through cable 300 can also charge the batteries of audio player 302. Switch 308 of cable 300 can provide a convenient manner of switching audio player 302 between music playback mode and data storage and transfer mode without plugging and unplugging cable 300 from audio player 302. Using cable 300 that utilizes switch 308 is preferable since plugging and unplugging B connector 310 into audio player 302 causes wear and tear and become tedious for the user.

While this invention has been described in terms of several preferred embodiments, there are alteration, permutations, and equivalents, which fall within the scope of this invention. It should also be noted that there are many alternative ways of implementing the methods and apparatuses of the present invention. It is therefore intended that the following appended claims be interpreted as including all such alterations, permutations, and equivalents as fall within the true spirit and scope of the present invention.

I claim:

1. A cable for transmitting data and power comprising:

a transmission medium configured to transmit data signals and power;

a first connector formed at a first end of the transmission medium;

a second connector formed at a second end of the transmission medium;

an alternative power connector formed on the transmission medium; and a switch positioned on the transmission medium, the switch being switchable between at least two modes wherein in a first mode power is transmitted through the transmission medium between the first connector and the second connector, and wherein in a second mode power is transmitted through the transmission medium between the alternative power connector and the second connector.

2. A cable for transmitting data and power as recited in claim 1 wherein the switch further comprises:

a third mode wherein in the third mode no power is transmitted to the second connector.

3. A cable for transmitting data and power as recited in claim 1 further comprising:

an alternative power cable that connects an alternative power source to the alternative power connector.

4. A cable for transmitting data and power as recited in claim 1 further comprising:

a first computing device that is connected to the first connector; and a second computing device that is connected to the second connector wherein the first computing device delivers data signals and power to the second computing device through the transmission medium.

5. A cable for transmitting data and power as recited in claim 1 wherein the switch can be remotely controlled to change the switch between the first and second modes.

6. A cable for transmitting data and power as recited in claim 1 further comprising:

at least one light emitting diode configured to indicate whether the switch is in the first or second mode.

7. A cable for transmitting data and power as recited in claim 1 wherein the transmission medium is of a type selected from the group consisting of a Firewire and a USB cable.

8. A cable for transmitting data and power as recited in claim 1 wherein the transmission medium is a bus-powered serial cable.

9. A cable for transmitting data and power as recited in claim 1 wherein the switch further comprises a lever that extends from the switch, the lever being adjustable between at least two positions, wherein each of the lever positions corresponds to a respective are of the switch modes.

10. A cable for transmitting data and power as recited in claim 1 wherein the switch is located between the first and second connector.

11. A bus-powered serial cable for transmitting data and power comprising:

a transmission medium configured to transmit data signals and power;

an A-connector formed at a first end of the transmission medium;

a B-connector formed at a second end of the transmission medium;

an alternative power connector formed on the transmission medium; and a switch positioned on the transmission medium, the switch being switchable between at least two modes wherein in a first mode power is transmitted through the cable between the A-connector and the B-connector, and wherein in a second mode power is transmitted through the cable between the alternative power connector and the B-connector.

12. A cable for transmitting data and power as recited in claim 11 further comprising:

an alternative power cable that connects an alternative power source to the alternative power connector.

13. A cable for transmitting data and power as recited in claim 11 further comprising:

a first computing device that is connected to the A-connector; and a second computing device that is connected to the B-connector wherein the first computing device delivers data signals and power to the second computing device through the transmission medium.

14. A cable for transmitting data and power as recited in claim 11 wherein the second computing device is an audio file player.

15. A cable for transmitting data and power in an Ethernet network comprising:

a transmission medium configured to transmit data signals and power;

a first connector formed at a first end of the transmission medium;

an Ethernet node connected to the first connector;

a second connector formed at a second end of the transmission medium;

a DC powered Ethernet node connected to the second connector;

a power injector connected to the transmission medium in order to transmit power to the second connector;

an alternative power connector formed on the transmission medium;

a switch positioned on the transmission medium, the switch being switchable between at least two modes wherein in a first mode power is transmitted through the transmission medium between the power injector and the second connector, and wherein in a second mode power is transmitted through the transmission medium between the alternative power connector and the second connector.

* * * * *